US007525514B2

(12) United States Patent
Ohno

(10) Patent No.: US 7,525,514 B2
(45) Date of Patent: Apr. 28, 2009

(54) PLASMA DISPLAY APPARATUS

(75) Inventor: Shinichi Ohno, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 646 days.

(21) Appl. No.: 11/166,442

(22) Filed: Jun. 23, 2005

(65) Prior Publication Data

US 2006/0001601 A1 Jan. 5, 2006

(30) Foreign Application Priority Data

Jun. 25, 2004 (JP) ..... 2004-188411

(51) Int. Cl.
*G09G 3/28* (2006.01)
*G09G 5/10* (2006.01)

(52) U.S. Cl. ..... 345/60; 345/690

(58) Field of Classification Search ..... 345/690, 345/60–72

See application file for complete search history.

(56) References Cited

U.S. PATENT DOCUMENTS 7,139,008 B2 * 11/2006 Mori et al. ..... 345/690
7,158,169 B1 * 1/2007 Farber et al. ..... 348/173
2004/0257305 A1 * 12/2004 Liao et al. ..... 345/60

FOREIGN PATENT DOCUMENTS

JP 2003-308041 10/2003
JP 2004-015288 1/2004

* cited by examiner

*Primary Examiner*—Amr Awad
*Assistant Examiner*—Randal Willis
(74) *Attorney, Agent, or Firm*—Yokoi & Co., U.S.A., Inc.; Peter Ganjian

(57) ABSTRACT

According to the present invention, a CPU 28*a* shifts target pixels in steps S305, S310, and S335, and at the same time references the image data in a frame memory 23*f* and checks whether the image is inactive, based on the difference in successive images, and whether the pixels are bright, based on the image data, in steps S320 and S325 respectively. When the image is liable to burn-in, a variable DF is incremented and a time interval t1 is updated every 5 minutes, the time interval t1 is being set shorter for an image liable to burn-in, i.e. the amount of motion is small and many pixels are bright, and set longer for an image not liable to burn-in, i.e. the amount of motion is large and many pixels are dark, at this time.

12 Claims, 7 Drawing Sheets

FIG. 7

| DF | t1 |
|---|---|
| 0 to 10,000 | 30 minutes |
| 10,001 to 50,000 | 25 minutes |
| ⋮ | ⋮ |
| 800,001 to 900,000 | 10 minutes |
| 900,001 to 1,000,000 | 7 minutes |
| 1,000,000~ | 5 minutes |

PLASMA DISPLAY APPARATUS

BACKGROUND OF THE INVENTION

1. Field of the Invention

The present invention relates to a plasma display device and more specifically to a plasma display apparatus that prevents a burn-in on the panel.

2. Description of the Prior Art

Conventionally, there is a screen saver function that prevents a burn-in on a screen by shifting an image being displayed up, down, right, and left on the screen by the specified number of pixels at regular intervals. The screen saver shifts the image being displayed at a predetermined interval, and therefore the user can set the shifting interval.

Also, as a technology to prevent a burn-in on a panel when a still image continues to be displayed, there is known the technology to display a screen saver produced from an video image, as disclosed in Japanese Patent Laid-Open No. 2004-015288 (Patent document 1).

Furthermore, for prevention of a burn-in when an image including moving portions is being displayed, there is known the technology to prevent a burn-in on a screen by lowering the brightness of a picture signal for the still portion of the image, as disclosed in Japanese Patent Laid-Open No. 2003-308041 (Patent document 2).

The prior arts described above have the following problems:

Even though the image shifting interval can be set by the user, the once-set interval will not change and thus may become inappropriate depending on broadcast program, etc.

Regarding the technology of displaying a screen saver produced from a video image, an image the user is viewing may be interrupted and consequently the image the user needs to see will not be displayed.

As for the technology to lower the brightness of a picture signal, part of the image is darkened and the viewer may feel uncomfortable with a change in the image.

SUMMARY OF THE INVENTION

The present invention has been made in view of the above problems and an object of the present invention is to provide a plasma display apparatus wherein a burn in on the plasma display panel can be prevented without causing the viewer to feel uncomfortable with a change in the viewing image.

To achieve the above object, the present invention provides a plasma display apparatus comprising a picture signal processor that performs a predetermined video signal processing for an input picture signal to produce a picture signal that is displayed on a plasma display panel, and a plasma display panel module that displays the picture signal on the plasma display panel via an XY drive circuit that inputs the picture signal produced in the picture signal processor, the plasma display apparatus further comprising: a frame shift processor that shifts the frame displayed on the plasma display panel by several pixels in one of the up, down, left, and right directions, a state detection processor that detects the state of an image based on the picture signal output to the plasma display panel module, and an automatic shift-time adjusting processor that changes the shift time interval for the frame according to the state of the image detected by the state detection processor.

In the present invention configured as above, the state of the image is detected from the picture signal, and the shift time interval for the image based on the result of the detection.

Generally, the cause of a burn-in on a plasma display panel is, for example, that a displayed image does not change for a long time, or that the brightness of an image is high. Therefore, the state detection processor serves the purpose if it is able to detect the state of the image. Also, the cause of a burn-in is not limited to the above examples.

Detecting the state in which a burn-in of the image is likely to occur and shifting the frame will prevent the same pixels of multiple pixels consisting of the plasma display panel from being in the same state for a long time, thereby preventing a burn-in of the image.

As described above, according to the present invention, it is possible to prevent the burn-in on the plasma display panel by detecting the state of an image and adjusting the frame shift time automatically.

Then, an arbitrary threshold is set for the result from the state detection processor for the image. If it is determined, based on the threshold set by the automatic shift-time adjusting processor, that a burn-in is about to occur on the image, the shift time interval for the frame is shortened and the frame is shifted by several pixels in the up, down, left, or right direction by the frame shifting processor. Any threshold can be set for the state detection. For instance, a threshold may be set for the motion of the frame so that the state in which the image is motionless for a long time just like a still image can be detected, or for the brightness level of the image.

In another embodiment of the present invention, the picture signal processor is provided with a first frame memory that stores several frames of image data produced in a video coder that performs the predetermined processing for an input picture signal, and the state detection processor described in Claim 2 hereof is provided with a first motion detector that determines the difference in image data between successive frames stored in the first frame memory to detect the amount of motion of the displayed image.

In this embodiment configured as above, the first motion detector detects the difference between the successive image data stored in the first frame memory, which stores the image data produced in the video decoder, and thereby detects the moving part of the image.

Here, the motion detector determines the state by detecting the degree of motion of the displayed image. If the degree of motion of the displayed image is low, the image is considered almost a still image, and therefore this inactive state is eliminated by shortening the shift time interval.

In still another embodiment of the present invention, the picture signal processor is provided with a second frame memory that stores several frames of image data which have been scaled by the scaler, and the state detection processor described in Claim 2 hereof is provided with a second motion detector that determines the difference in image data between successive frames stored in the second frame memory.

In this embodiment configured as above, the second motion detector detects the difference between the successive image data stored in the second frame memory that stores the image data which have been scaled as described above, and thereby detects the moving part of the image.

Here, the effect of the motion detection for images stored in the second frame memory is the same as that for images stored in the first frame memory. Generally, the number of pixels of a plasma display panel is larger than that equivalent to the image of the NTSC-system television, and the scaler increases the number of pixels by scaling so as to match the number of pixels of the plasma display panel. Therefore, using the difference in images stored in the second frame memory allows the cause of a burn-in to be determined for every pixel accurately.

In contrast, when the first frame memory is used the amount of processing can be reduced due to fewer number of pixels.

This embodiment prevents a burn-in to be caused by inactivity of an image.

In other embodiment of the present invention, the frame shift processor shifts a frame by shifting the picture signal by several pixels after being scaled, and writing the frame to the second frame memory.

In this embodiment configured as above, the image data that has been scaled is shifted by several pixels and written to the second frame memory.

Here, writing the image data to the second frame memory is done by shifting the write start position for entire frame by several pixels, when storing the image data for entire frame in the second frame memory after being scaled.

According to this embodiment, the picture signal processor can control the frame shift.

In another embodiment of the present invention, the frame shift processor shifts a frame by shifting the pixel column to be driven by the XY drive circuit.

In this embodiment configured as above, the image data produced by the picture signal processor is output to the plasma display panel module. Then, the XY drive circuit shifts the pixel column of the image data input to the display panel module in X or Y direction, and output it to the plasma display panel. At this time, one of the up, down, left, and right direction is selected each time for the direction of shifting the image data after shifting the pixel column, and the image is displayed.

According to this embodiment, the frame shift can be controlled by a plasma display panel driver.

In other embodiment of the present invention, the state detection processor shortens the shift time interval when the image being displayed on the plasma display panel is bright.

In this embodiment configured as above, the state detection processor detects the brightness level of the image, and if the detected image is determined to be bright, shortens the shift time interval for the image so that the pixels will not emit light at the same brightness for a long time.

Here, the state detection processor checks the degree of brightness by setting a threshold for the brightness of the image. The threshold may be set to any brightness at which a burn-in on the plasma display panel is likely to occur in a short period of time. Any measure may be used for determining the brightness of the image, such as the brightness of the pixels consisting of the plasma display panel, the output of the illuminant of each pixel, or the current value when the illuminant is emitting light, if only the brightness can be determined.

In another embodiment of the present invention, the state detection processor determines that the image is bright when the output level of any one of the RGB signals of the digital picture signal.

In this embodiment configured as above, a threshold is set for each level of the RGB signals of the digital picture signal, and if any one of the levels of the RGB signals exceeds the threshold, the image is determined to be bright.

The plasma display panel is formed by multiple pixels consisting of three illuminant colors, red (R), G (green), and B (blue), and these illuminants emit light to display an image on the plasma display panel. The RGB signals is output to the plasma display panel through the procedure: extraction of R, G, B color signals from an analog picture signal input to the picture signal processor, A/D conversion, predetermined signal processing, gamma adjustment, etc.

According to this embodiment, burn-in of the image is further prevented by setting a shift time according to the brightness of the image.

In view of the above configuration, another embodiment of the present invention provides a plasma display apparatus comprising: a plasma display panel whose display surface is formed by multiple pixels; a tuner that receives a television signal of the desired frequency via an antenna and selects only the required signals from the received television signals to output analog picture signals; an analog/digital conversion circuit that inputs the analog picture signals from the tuner and converts them to digital signals with predetermined signal level range corresponding to each signal level; a picture signal processor that performs the predetermined digital picture signal processing for the converted digital signals; a frame memory that stores inputs the produced digital picture signals and at the same time stores digital picture signals to form one frame of image; a scaler that performs the predetermined scaling according to the display screen; a plasma display panel driver that displays the image on the plasma display panel; and a microcomputer to control these devices, characterized in that the plasma display apparatus further comprises: a frame shift processor consisting of the scaler that shifts the image to be displayed on the plasma display panel in one of the up, down, left, and right directions; a state detection processor that determines the difference between frames based on the digital picture signals stored in the frame memory to detect the amount of motion of the image, and also detect the brightness of the image to be displayed on the plasma display panel; and an automatic shift-time adjusting processor that sets shorter the shift time interval for the image, as the degree of motion decreases and the brightness of the image increases, based on the degree of motion and the brightness of the image detected by the state detection processor.

Needless to say, the same effects as described above can be achieved also in this concrete configuration.

BRIEF DESCRIPTION OF THE DRAWINGS

FIG. 7 is a table showing the correspondence between a variable DF and a time interval t1.

DESCRIPTION OF THE PREFFERED EMBODIMENT

Figure 1:
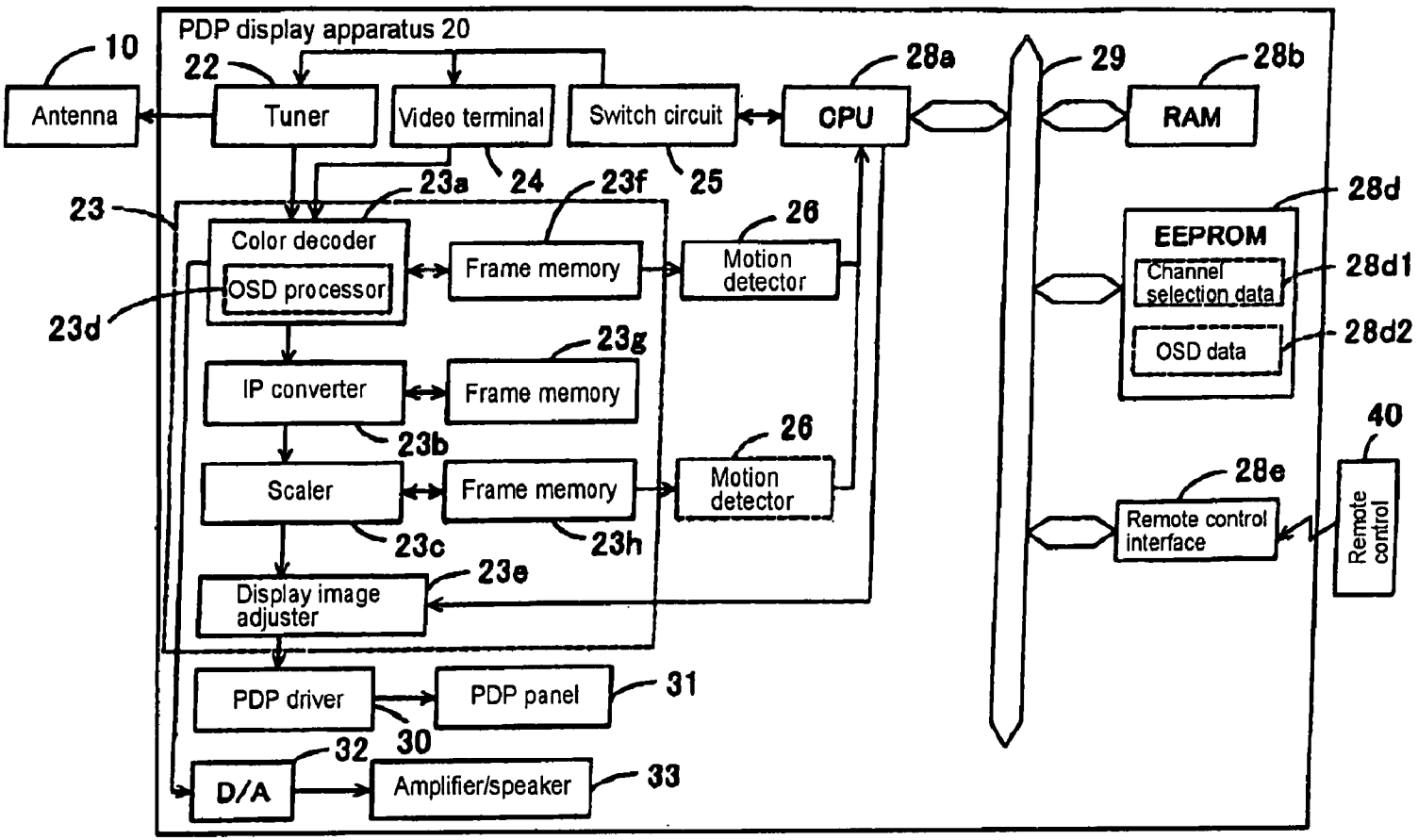
FIG. 1 is a block diagram showing the basic configuration of a PDP display apparatus according to the present invention.

Preferred embodiments of the present invention will be described below in the following order:

(1) Configuration of a plasma display apparatus (2) Description of a screen saver function (3) Description of a time interval setting function (4) Description of the operation (5) Variations (6) Conclusion (1) Configuration of a plasma display apparatus:

FIG. 1 is a block diagram showing the configuration of a display apparatus (plasma display television) that is a television provided with a plasma display panel (PDP) according to the present invention. In this figure, a PDP display apparatus 20 contains a tuner 22 to which a frequency signal is input from an antenna 10. The tuner 22 is a so-called synthesizer type tuner wherein PLL data, i.e. frequency division ratio data from the variable frequency divider circuit in a PLL loop is fed to the tuner 22, as a channel selection control signal.

The PDP display apparatus 20 has a video input terminal 24 to which an external device such as a DVD player can be connected, and through which video and audio signals from a DVD player, etc. can be input. A switch circuit 25 is connected to the tuner 22 and the video input terminal 24. This switch circuit 25 is provided to enable either a picture signal from the tuner 22 or a picture signal from the video input terminal 24, and feed the enabled picture signal to a picture signal processor 23 described below. That is, the display apparatus 20 according to the present invention is configured to allow both the reception of television broadcast pictures and the display of images from a DVD player and the like.

The output from the tuner 22 or the video input terminal 24 is fed to a picture signal processor 23. The picture signal processor 23 is provided with a color decoder 23*a*, an IP converter 23*b*, a scaler 23*c*, and a display image adjuster 23*e*. The color decoder 23*a* demodulates three primary color signals R, G, and B from an input signal. Also, the color decoder 23*a* is provided with an A/D converter (not shown) by which the input three primary color signals R, G, and B are converted to digital signals. Furthermore, the color decoder 23*a* separates a picture signal from an audio signal and feeds the separated audio signal to a D/A converter 32 described below. The color decoder 23*a* also contains an OSD processor 23*d* which can perform the displaying of a predetermined still image over a picture, the replacing of the predetermined still image with another to display it, and the like. The OSD processor 23*d* can input data, such as character information, from a CPU 28*a* and produces a still image based on such data.

An IP converter 23*b* converts successive interlaced picture signals into progressive picture signals. The scaler 23*c* translates the input digital picture signal to match the size of the screen of the PDP panel 31. The color decoder 23*a*, the IP converter 23*b*, and the scaler 23*c* can use frame memories 23*f*, 23*g*, and 23*h* respectively as work areas to perform respective processing.

Figure 2:
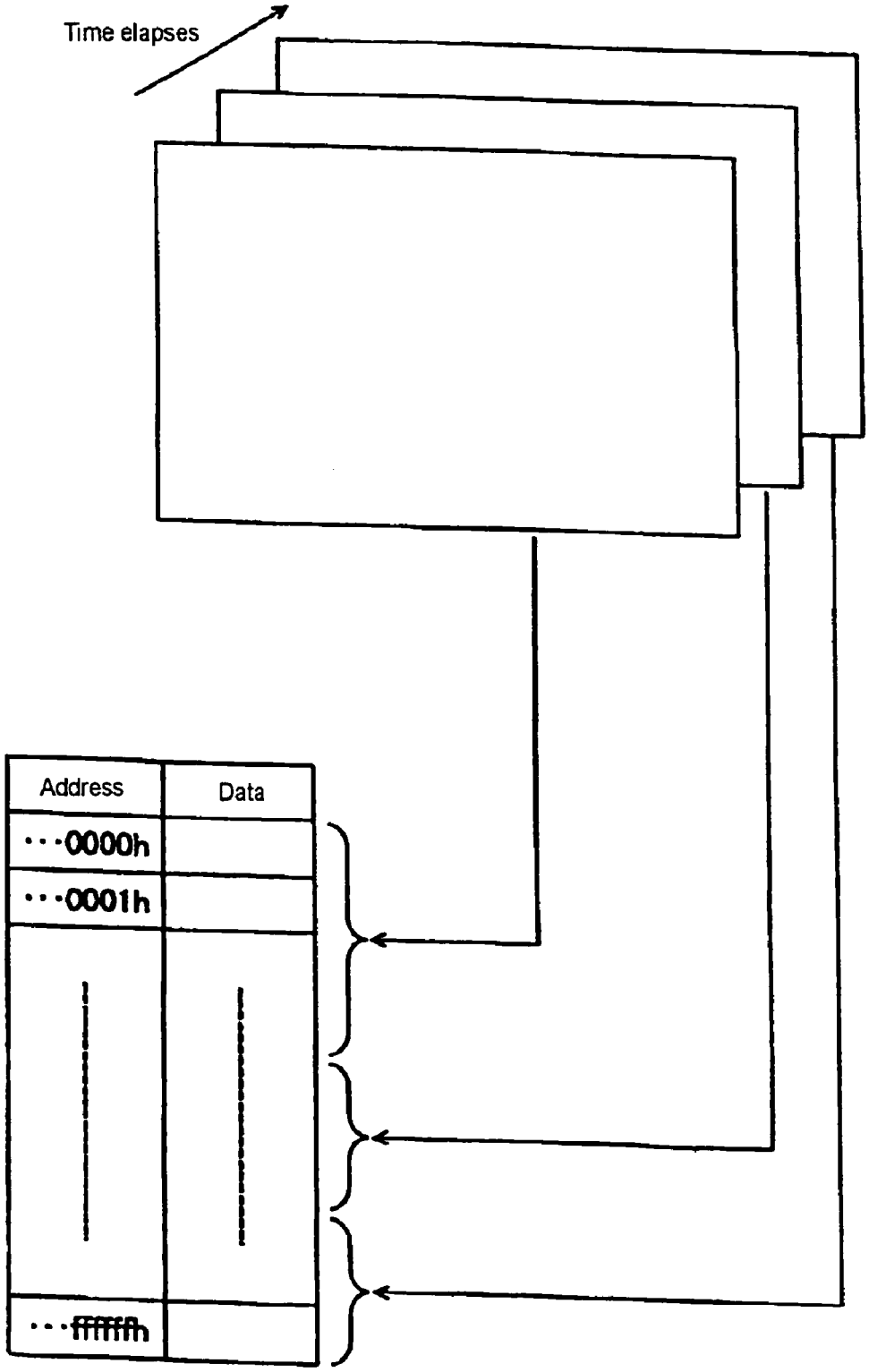
FIG. 2 shows the correspondence between frame memory and images.

FIG. 2 shows the relationship between the frame memories 23*f*, 23*g*, and 23*h* and display images. As shown at the top in this figure, a television screen displays images that are changing sequentially over time. In the PDP display apparatus 20 according to the present invention, the frame memories 23*f*, 23*g*, and 23*h* store image data for multiple frames with a frame of sequentially changing images as a unit. Respective frame memories 23*f*, 23*g*, and 23*h* are the memory having address space for the number of pixels corresponding to respective frame memories. For instance, the frame memory holding three frames of image data as shown in FIG. 2 is made to store image data with the address space from a predetermined start address to a predetermined end address as a single frame. It is possible to write or read from the image data in a timesharing manner and also possible to obtain the difference between corresponding pixels of different images. In this embodiment, the frame memory 23*f* holding the image data processed by the color decoder corresponds to a first frame memory, and the frame memory 23*h* holding the image data processed by the scaler corresponds to a second frame memory.

A motion detector 26 is connected to the frame memory 23*f* that can be used as a work area by the color decoder 23*a*. The motion detector 26 detects the difference between frames of a picture signal, i.e. a frame of image data, stored in the frame memory 23*f*, and can regard, based on this difference, an image that is motionless for a predetermined time period or longer as a still image and regard the other images as moving images, or can determine the amount of the difference as the amount of motion. The threshold for determining whether to regard an image as a still image or a moving image is separately set, and therefore a motionless image is not always regarded as a still image.

The result from the motion detector 26 is transmitted to the CPU 28*a*. When the CPU 28*a* receives from the motion detector 26 the result that an image is determined as a still image, the CPU 28*a* measures the elapsed time (T) from that point and performs a screen saver function described below. The motion detector 26 need not always be provided in the frame memory 23*f*, and it is possible to provide it in the frame memory 23*h* as shown by a dotted line in FIG. 1.

Also, the CPU 28*a* causes the stored image data to be held in the frame memory 23*f* according to the predetermined halt operation via a remote control 40 or the like, and a still image from the image data to be displayed on the PDP panel 31.

The display image adjuster 23*e* includes a γ correction circuit and produces a display image based on the input picture signal. The display image adjuster also adjusts the hue and brightness of an image, reducing digital noises, etc. to reflect the user's preference.

A PDP driver 30 includes an LVDS conversion circuit and displays various images on the PDP panel 31 via an XY drive circuit 30*a* according to the output from the display image adjuster 23*e*.

Figure 3:
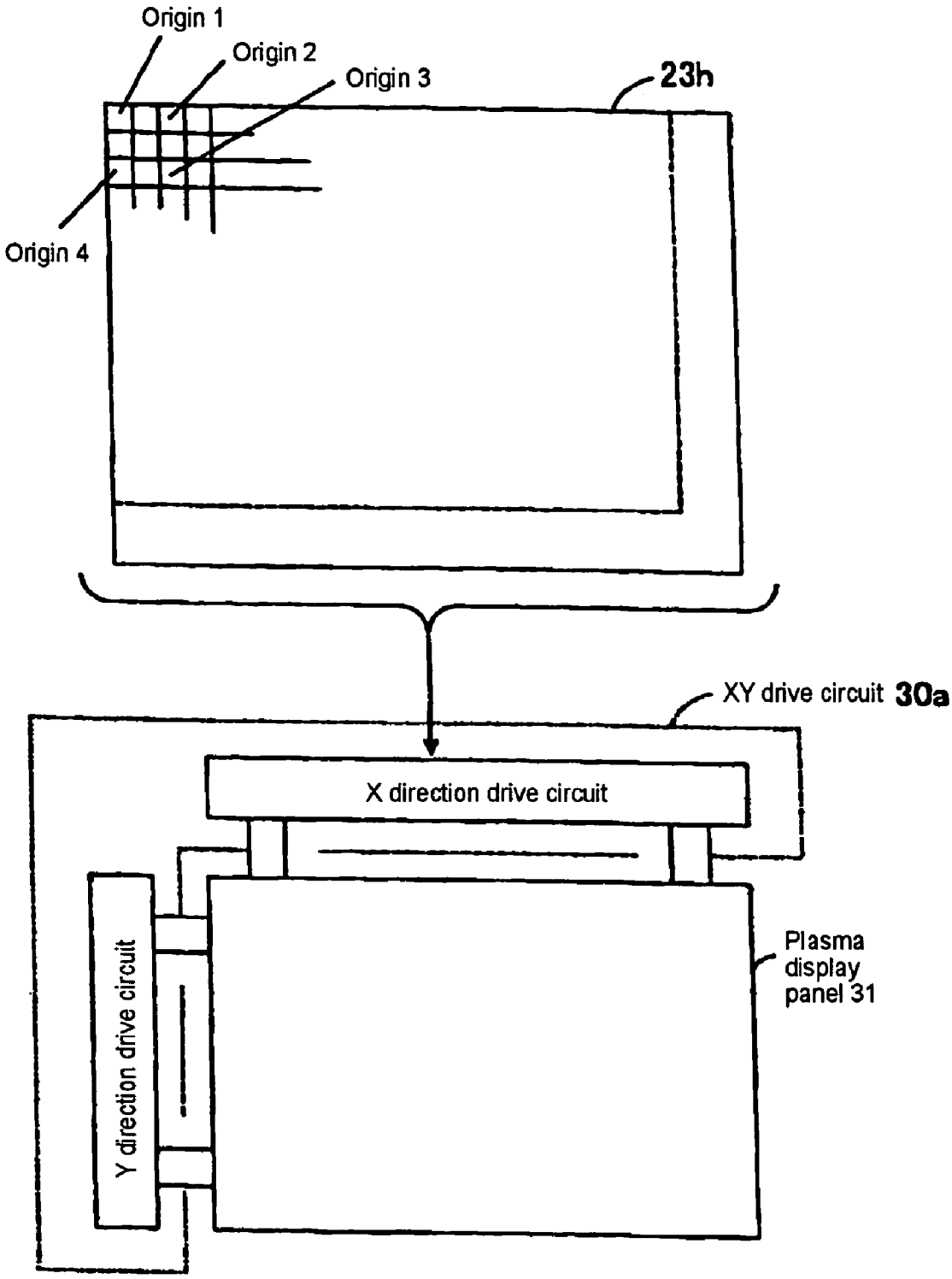
FIG. 3 shows how an XY drive circuit drives a PDP panel based on the frame memory.

FIG. 3 shows the relationship between the frame memory and the PDP driver 30.

The frame memory 23*h* is a memory space capable of storing an image that is larger than the number of pixels of the PDP panel 31 by several pixels in both X and Y directions, and the XY drive circuit 30*a* cuts out an image in the specific area from this larger frame and drives the PDP panel 31. In the example shown in FIG. 3, it is possible to specify four origins, i.e. origin 1, origin 2, origin 3, and origin 4, which are shifted by ±2 pixels from each other in X and Y directions, and an image with its upper left corner at one of these origins is displayed. Here, since the location of an image is shifted depending on which origin of the four origins is selected, thus configuring a frame shift processor. However, an image to be displayed on the PDP panel 31 by the XY drive circuit 30*a* will be shifted by changing the location in the frame memory 23*h* where the scaler 23*c* writes the image when scaling the image based on the IP-converted image, instead of changing the origin 1, origin 2, origin 3, and origin 4 in the XY drive circuit. More specifically, if the origin of image data to be written can be selected from the four origins, and also the XY drive circuit is made to always display an image starting at the origin 4, then a frame can be shifted likewise and thus the frame shift processor can be configured.

An audio signal output from the color decoder 23*a* is input to an amplifier/speaker 33 through the D/A converter 32.

The CPU 28*a* is connected to a bus 29 and uses a RAM 28*b* connected to the bus 29 as a work area to perform the control processing to implement various functions of the PDP display apparatus 20. Also, the CPU 28*a* performs the control processing using various data stored in an EEPROM 28*d* that is connected to the bus 29.

The EEPROM 28*d* stores channel selection data 28*d*1. This channel selection data 28*d*1 is used to select a frequency band to be received by the tuner 22, based on the receiving channel selection instruction via the remote control 40, etc. The EEPROM 28*d* also stores OSD data 28*d*2 to cause the OSD processor 23*d* to perform the OSD processing.

A remote control interface 28*e* is connected to the bus 29, through which an infrared blink signal from the remote control 40 can be input. This infrared blink signal is transmitted to the CPU 28*a* via the bus 29 to cause the CPU 28*a* to perform the corresponding control processing.

(2) Description of the Screen Saver:

As described above, a motion in an image can be detected by the motion detector 26. The CPU 28*a* performs the screen saver function based on the result from the motion detector 26.

Figure 4:
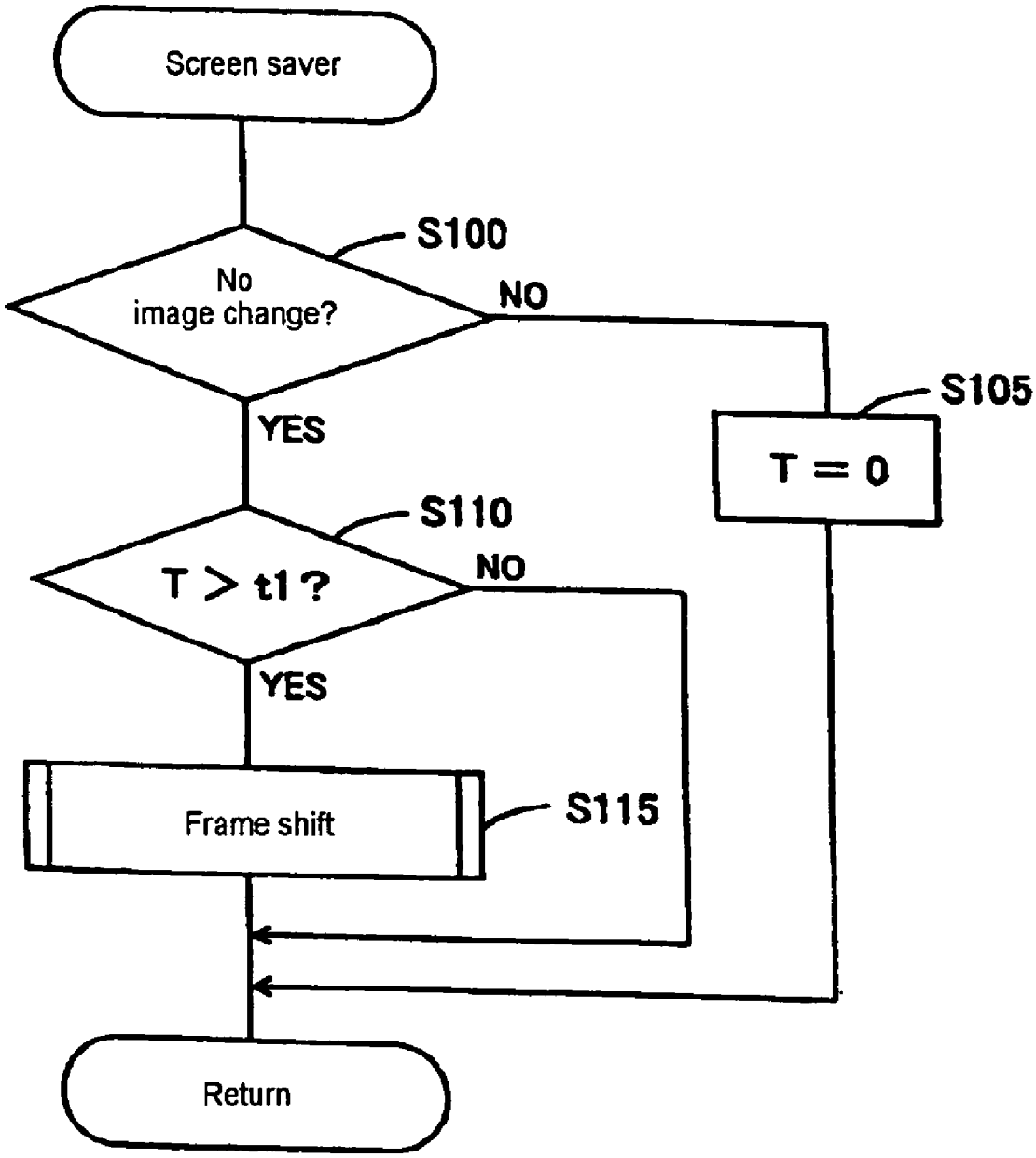
FIG. 4 is a flowchart showing a screen saver function.

FIG. 4 is a flowchart showing how the CPU 28*a* performs the screen saver function. In step S100, the CPU 28*a* determines whether there is any motion in the image based on the result from the motion detector 26, and if any change is detected, the CPU 28*a* assigns 0 to a variable T in step S105 that represents the period of time during which there is no change in the image and then terminates the processing. The variable T is designed to increment each time it is activated at regular intervals by the elapsed time measurement processing that is activated by a timer interrupt, not shown, and therefore it is possible to know the elapsed time from the point at which the variable T is reset to 0, by referencing the variable T at a given point in time.

On the other hand, if it is determined that there is no change in the image, the CPU 28*a* checks, in step S110, whether the elapsed time represented by the variable T has exceeded a preset shift time interval. As described below, the shift time interval is to be set as a variable t1, and step S110 checks whether the value of the variable T exceeds the value of the variable t1. If the T's value is not over the t1's value, it is determined that the elapsed time has not exceeded the shift time interval and thus the processing is terminated. Otherwise, the frame shift processing is performed in step S115.

Figure 5:
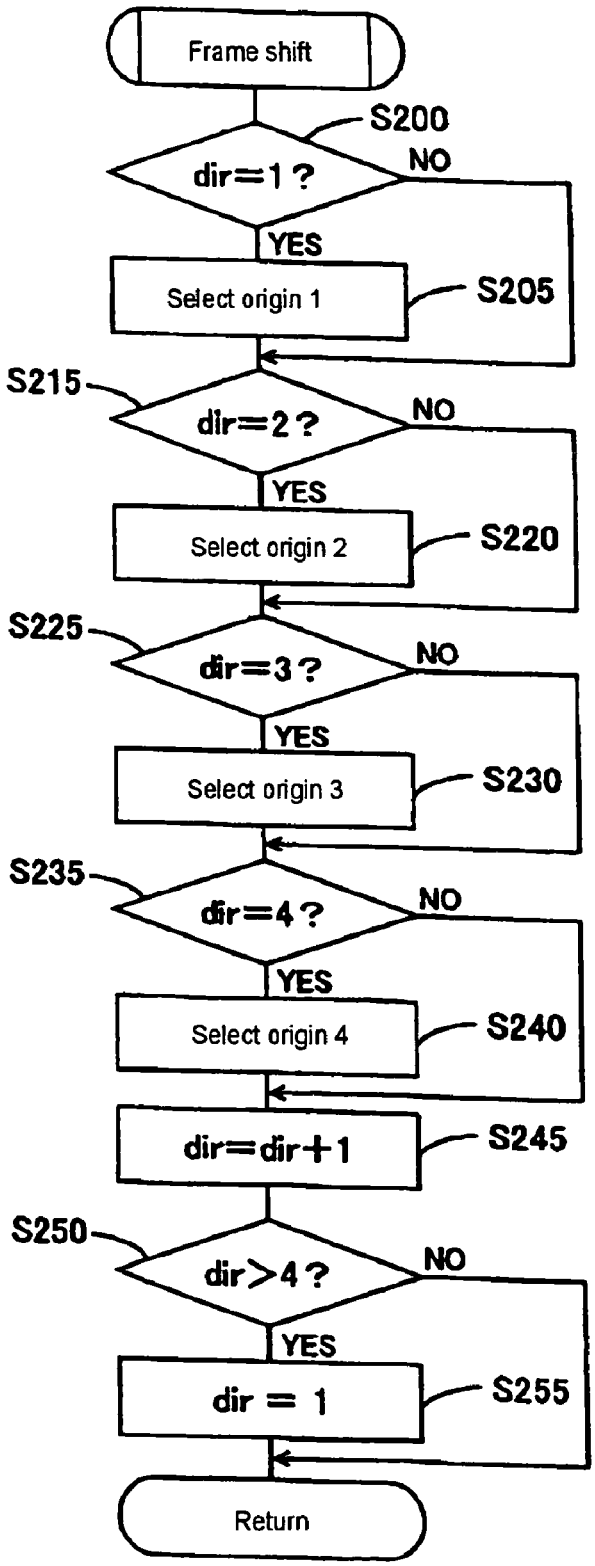
FIG. 5 is a flowchart showing a screen shifting process.

FIG. 5 is a flowchart showing how the frame shift processing is performed.

As shown in the figure, it is determined, in step S200, whether 1 is assigned to a variable dir that represents an origin to be selected from the origin 1, origin 2, origin 3, and origin 4, and if the value of this variable is 1, the origin 1 is selected in step S205. Selecting the origin 1 causes the XY drive circuit 30*a* to display an image with its upper left corner at the origin 1, which is stored in the frame memory 23*h*, on the PDP panel 31. In steps S215, S225, and S235, the origin is to be reset to the origin 2, origin 3, and origin 4 respectively according to the value of the variable dir, and accordingly the image to be displayed is shifted within ±2 pixels, as the origin changes.

This variable dir is incremented by 1 in step S245, and if it is determined that this variable has exceeded 4 it will be reset to 1. That is, the variable dir changes sequentially within the range of 1 to 4 each time the frame shift processing is activated, and the image to be displayed is shifted in turn within ±2 pixels as this variable changes.

In addition to this frame shift method in which the origin is changed, it is also possible to change the origin when the scaler 23*c* writes an image to the frame memory 23*h*. In this case, the origin may be changed each time an image is written, as in the processing described above.

(3) Description of the Time Interval Setting Function:

As described above, the PDP display apparatus 20 performs the frame shift at the predetermined time interval t1 when no motion is detected in an image. According to the present invention, this predetermined time interval t1 itself is dynamically changed.

Figure 6:
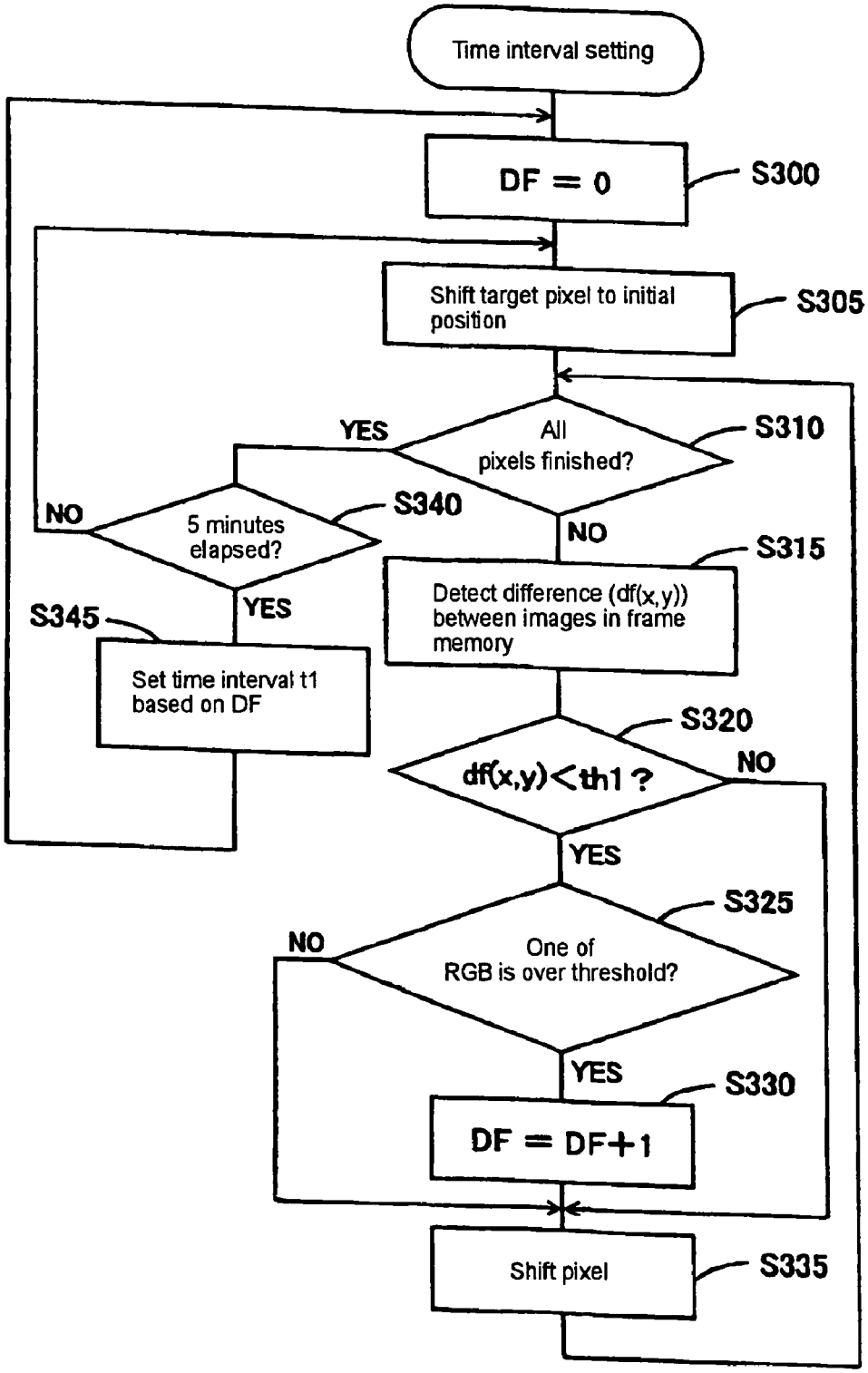
FIG. 6 is a flowchart showing a time interval setting process.

FIG. 6 is a flowchart showing how this time interval setting processing to be activated by a timer interrupt is performed.

In step S300, a variable DF representing a motion in an image is initialized to 0. In this embodiment, the predetermined time interval t1 is updated every 5 minutes based on the value of the variable DF.

In step S305, the target pixel is shifted to the initial position. In this embodiment, the time-series difference between images in the frame memory 23*f* is determined. To determine the difference between images, it is necessary to determine the difference in data of corresponding pixels between successive images, and therefore the accumulated value of the difference is determined while shifting this target pixel across the entire frame. As the first step, the target pixel is shifted to the initial position in step S305. Step S310 checks whether one frame of shift is completed, and unless one frame of shift is completed, the difference df (x, y) in the target pixel between images in the frame memory 23*f* is detected in step S315.

The difference df (x, y) simply represents a time-series change in image data, and when this change is small the amount of motion in the image may be small. Step S320 checks whether the difference is less than a threshold th1, and if it is less than the threshold th1, then step S325 checks whether that pixel is bright. The brighter the pixel is, the more likely it is that burn-in will occur. The term "bright" used here means not only that the pixel is simply white, but that each of the red, green, and blue (RGB) pixels provided to display the color of white is emitting light at nearly the maximum brightness. How bright each pixel becomes can be determined based on the RGB data, and therefore step S325 checks whether any of this RGB data exceeds a threshold th2 (equivalent to a brightness at which a burn-in is likely to occur). Only when it is more than this threshold, is the value of the variable DF incremented by 1 in step S330.

That is, steps S320 and S325 checks respectively whether the motion is small and whether the pixel is bright, and the value of the variable DF, which indicates the probability of burn-in, is incremented when the both requirements are satisfied. Even if the pixel is bright, burn-in is not likely to occur in an image with many motions. In contrast, burn-in is likely to occur in an image with few motions, but a dark image is not likely to cause a burn-in even if it has few motions.

After the above steps, pixels are shifted in step S335. Generally, pixels are shifted horizontally by one column, and when it reaches the end, the target is changed to the next column.

After the shifting of pixels is finished, control is returned to step S310. If it is determined that all the pixels in the image have been shifted, step S340 checks whether five minutes have passed. The five minutes is only a time interval to review the time interval and can be changed appropriately depending on various conditions. The concrete checking method is not limited, and therefore it is possible to provide a special variable and clock the time by incrementing this variable, as with the variable T, and perform the above check based on the value of this special variable.

After five minutes have passed, the time interval t1 is set based on the variable DF in step S345. As shown in FIG. 7, the correspondence between the value of the variable DF and the time interval t1 is listed in a table beforehand. In this example, if the value of the variable DF is more than 1,000,000 the time interval t1 is set to 5 minutes, and if the variable DF's value is more than 900,000 and less than 1,000,000 the time interval t1 is set to 7 minutes, and thus the time interval t1 is set longer as the value of the variable DF decreases. However, the maximum time interval t1 is 30 minutes.

Since the value of the variable DF is incremented if it is determined that the image has few motions and its pixels are bright, this table means that as the probability of a burn-in increases, the time interval t1 is set shorter.

(4) Description of the Operation:

The operation of this embodiment configured as above will be described below.

While the user is viewing the image on the PDP display apparatus 20, the motion detector 26 is detecting the motion of the image, and if no motion is detected, informs the CPU 28*a* of that fact. The CPU 28*a* checks, according to the flowchart shown in FIG. 4, whether the predetermined time interval t1 is exceeded by a time period during which the motion detector determined, based on its criteria, that there is no motion. If the motionless period is longer than the time interval t1, then the CPU 28*a* performs, in step S115, the frame shift processing as shown in FIG. 5 to shift the frame by predetermined number of pixels.

The time interval from the time at which an image becomes motionless to the time at which the frame shift is performed is not always the same, and the CPU 28*a* sets the time interval t1 by performing the time interval setting processing shown in FIG. 6 that is activated by a timer interrupt. Here, the CPU 28*a* shifts the target pixels in steps S305, S310, and S335, and at the same time checks whether the image has few motions, based on the difference between images, and whether the pixels are bright, based on the image data itself, in steps S320 and S325 respectively, and then increments the variable DF if a burn-in is likely to occur.

Then, step S345 is performed every 5 minutes based on the result of step S340, and the time interval t1 is changed based on the table shown in FIG. 7.

Needless to say, the time interval t1 is set shorter for an image liable to burn-in that has few motions and many bright pixels, and is set longer for an image not liable to burn-in that has many motions and many dark pixels.

(5) Modifications:

In the embodiment described above, the amount of motion is detected based on the image data in the frame memory 23*f*. However, it is also possible to detect the same based on the image data in the frame memory 23*h* as mentioned above. Since the image data in the frame memory 23*f* is relatively little, the detection processing load can be reduced, which is an advantage. The image data in the frame memory 23*h* corresponds to each pixel of the actual PDP panel 31, and therefore it is possible to determine the liability to burn-in for every pixel. This allows more accurate judgment and more flexible setting of the time interval.

The time interval t1 shown in FIG. 7 is the time interval corresponding to the predetermined PDP panel 31 and is only an example. This is because the liability to burn-in changes with the characteristics of the panel or the driver circuit. Therefore, there is also an example in which the time interval should be shorter. In this case, it is possible to set the time interval t1 to, for instance, 10 minutes when the DF value is 0 to 10,000, 8 minutes when the DF value is 10,001 to 50,000, 1 minute when the DF value is 80,001 to 900,000, 30 seconds when the DF value is 900,001 to 100,000, and 10 seconds when the DF value is more than 100,001. In such a case, the timer to determine whether to set the time interval t1 in step S340 should be set to within 10 seconds.

Moreover, other thresholds described above should also be changed appropriately according to the design.

(6) Conclusion:

As described above, in this embodiment, the CPU 28*a* shifts the target pixels in steps S305, S310, and S335, and at the same time checks whether the image has few motions, based on the difference between images, and whether the pixels are bright, based on the image data itself, in steps S320 and S325, increments the variable DF if a burn-in is likely to occur, and then updates, in step S345, the time interval t1 every 5 minutes based on the result of step S340. At this time, the time interval t1 is set shorter for an image with few motions and many bright pixels and liable to burn-in, and is set longer for an image with many motions and many dark pixels and not liable to burn-in. This eliminates the complex procedure of setting the time interval t1 and also allows the setting of an optimum time interval t1 according to the actual liability to burn-in.

I claim:

1. A plasma display apparatus, comprising:

a picture signal processor that performs a predetermined video signal processing for an input picture signal to produce picture signals to be displayed on a plasma display panel;

said picture signal processor is provided with a first and a second frame memory, with the second frame memory storing several frames of image data scaled by a scaler;

a plasma display panel module that displays said picture signals via an XY drive circuit that inputs said picture signals produced by said picture signal processor;

a frame shift processor that shifts, by several pixels, the image to be displayed on said plasma display panel, in one of the up, down, left, and right directions;

a state detection processor that detects the state of the image based on the picture signal to be output to said plasma display panel module;

said state detection processor is provided with a first and a second motion detector, with the second motion detector determining the difference in image data between successive frames input to said second frame memory; and an automatic shift-time adjusting processor that changes the shift time interval for said frame according to the state of said image detected by said state detection processor.

2. A plasma display apparatus of claim 1, wherein:

said picture signal processor is provided with the first frame memory that stores several frames of image data produced by a video decoder that performs the predetermined processing for an input picture signal; and said state detection processor is provided with the first motion detector that determines the difference in image data between successive frames stored in said first frame memory, and detects the amount of motion of the displayed image.

3. A plasma display apparatus of claim 1, wherein said state detection processor determines whether the amount of motion is small and the pixels are bright, and, when both of these requirements are satisfied, increases the value of a variable indicating the liability to burn-in.

4. A plasma display apparatus of claim 3, wherein said state detection processor determines that the image is bright when any one of the RGB signals of said digital picture signals has a large output level.

5. A plasma display apparatus of claim 1, wherein said frame shift processor shifts the frame by shifting, by several pixels, said picture signals scaled as predetermined and writing them to said second frame memory.

6. A plasma display apparatus of claim 5, wherein said second frame memory is a memory space capable of storing an image that is larger by several pixels in X and Y direction than the number of pixels of said plasma display panel.

7. A plasma display apparatus of claim 1, wherein said frame shift processor shifts the frame by shifting the pixel column to be driven by said XY drive circuit.

8. A plasma display apparatus of claim 7, wherein:

said XY drive circuit cuts out the image in a specific area from larger images and drives said plasma display panel;

four origins, origin 1, origin 2, origin 3, and origin 4, that are shifted by ±2 pixels in X and Y directions, can be specified and it is possible to display an image with one of these origins at its upper left corner; and said frame shift processor specifies one of the four origins, origin 1, origin 2, origin 3, and origin 4.

9. A plasma display apparatus of claim 1, wherein:

said frame shift processor is such that an variable is provided that indicates the time period during which an image does not change, and by incrementing said variable each time said variable is activated at regular intervals by elapsed time measurement processing to be activated by a timer interrupt, it is possible to know the elapsed time from the time at which said variable was reset to 0 by referencing said variable at any time;

it is determined whether there is any motion in the image based on the result from the motion detector, and when it determined that there is a motion in the image, 0 is assigned to a variable indicating a time period during which the image is motionless, and the processing is terminated; and if it is determined that there is a motion in the image, it is checked whether the elapsed time indicated by said variable has exceeded a preset shift time interval, and it is only checked whether the elapsed time is over a predetermined threshold, and if the elapsed time is within the predetermined threshold, it is determined that the shift time interval is not exceeded and the processing is terminated, and if exceeded the frame shift processing is performed.

10. A plasma display apparatus of claim 1, wherein said state detection processor shortens said shift time interval for the flame when the image displayed on the said plasma display panel is bright.

11. A plasma display apparatus of claim 1, wherein:

when the time interval setting processing, which is activated by a timer interrupt, sets the time interval from the time at which the image becomes motionless to the time at which image shift is performed, said shift time adjusting processor shifts the target pixels, and at the same time checks whether the amount of motion is small based on said difference in the image data stored in the first frame memory, and whether the pixels are bright pixels based on the image data itself, and increments a variable indicating the liability to burn-in when the probability of burn-in is high, and also changes the time interval based on the value of said variable by referencing a predetermined table at predetermined intervals.

12. A plasma display apparatus of claim 11, wherein said table is configured such that the time interval is set shorter for an image liable to burn-in, i.e. the amount of motion is small and many pixels are bright, and set longer for an image not liable to burn-in, i.e. the amount of motion is large and many pixels are dark.

* * * * *